US011581680B2

(12) United States Patent
Martin et al.

(10) Patent No.: US 11,581,680 B2
(45) Date of Patent: Feb. 14, 2023

(54) SPRING LOADED SELF-EJECTING CONNECTOR

(71) Applicant: TE Connectivity Services GmbH, Schaffhausen (CH)

(72) Inventors: Galen M. Martin, Middletown, PA (US); Brooke S. Glassman, Winston Salem, NC (US)

(73) Assignee: TE Connectivity Solutions GmbH

( * ) Notice: Subject to any disclaimer, the term of this patent is extended or adjusted under 35 U.S.C. 154(b) by 78 days.

(21) Appl. No.: 17/173,239

(22) Filed: Feb. 11, 2021

(65) Prior Publication Data

US 2022/0255264 A1 Aug. 11, 2022

(51) Int. Cl.
*H01R 13/635* (2006.01)
*H01R 13/629* (2006.01)

(52) U.S. Cl.
CPC ..... *H01R 13/635* (2013.01); *H01R 13/62911* (2013.01); *H01R 13/62922* (2013.01)

(58) Field of Classification Search
None
See application file for complete search history.

(56) References Cited

U.S. PATENT DOCUMENTS 7,632,116 B2 * 12/2009 Lee ..... H01R 13/635 439/372

* cited by examiner

*Primary Examiner* — Ross N Gushi

(57) ABSTRACT

A receiving electrical connector includes a body, a slide movably connected to the body and defining a cam surface, and an elastic element biasing the slide relative to the body in a first direction. The cam surface is adapted to bias a mating connector received by the receiving connector from a mated position into a partially mated position in response to a force placed on the slide in a direction opposite the first direction and against an elastic return force imparted on the slide by the elastic element. The cam surface is further adapted to bias the mating connector from the partially mated position to an ejected position under a force applied on the slide by the elastic element.

16 Claims, 8 Drawing Sheets

SPRING LOADED SELF-EJECTING CONNECTOR

FIELD OF THE INVENTION

The present disclosure relates to electrical connectors and, more particularly, to a self-ejecting and locking electrical connector.

BACKGROUND

Modern vehicles, by way of example, rely heavily on electrical systems for the implementation and control of various vehicle functions critical to both vehicle operation and occupant safety. Accordingly, the reliability of these systems, including their associated electrical interconnections, is of the utmost importance. During vehicle manufacturing for example, unintentional partial electrical connections formed between interconnected components can pose future risk to users, as well as negatively affect system reliability. In order to help prevent these types of assembly failures, prior art devices having included locking mechanisms for fixing connectors in a mated state. However, these locking mechanisms do not prevent accidental partial connections. Moreover, while mitigating unintentional connector disconnections, these locking mechanisms often increase the difficultly of connector disconnection, including requiring the application of higher unmating forces placed thereon. These difficulties can be exaggerated in space-constrained environments. Further, the higher forces required to unmate the electrical terminals of these connectors may result the application of excessive or improperly-placed force on the connecter or its associated wires, potentially causing damage to these sensitive components.

Accordingly, there is a need for improved electrical connector assemblies which ensure reliable electrical connections, while remaining relatively easy to disconnect.

SUMMARY

In one embodiment of the present disclosure a first electrical connector is provided which includes a body, a slide movably connected to the body, and an elastic element biasing the slide relative to the body in a first direction. The first connector is adapted to receive a corresponding second or mating connector in a mating direction. A cam surface defined on the slide is adapted to bias the mating connector from a mated position with the first connector into a partially mated position in response to a force placed on the slide in a direction opposite the first direction and against an elastic return force imparted on the slide by the elastic element. The cam surface is further adapted to bias the mating connector from the partially mated position to an ejected position via a force applied to the slide by the elastic element.

According to another embodiment of the present disclosure, an electrical connector assembly comprises a first connector including a body, a slide movably connected to the body, and an elastic element adapted to bias the slide relative to the body in a first direction. The assembly further comprises a second connector adapted to be mated to the first connector in a mating direction, and an ejecting assembly adapted to: 1) bias the second connector from a mated state with the first connector in a direction opposite the mating direction in response to a movement of the slide in a direction opposite the first direction; and 2) bias the second connector in a direction opposite the mating direction in response to movement of the slide in the first direction.

BRIEF DESCRIPTION OF THE DRAWINGS

The invention will now be described by way of example with reference to the accompanying Figures, of which.

DETAILED DESCRIPTION OF THE EMBODIMENTS

Figure 1A:
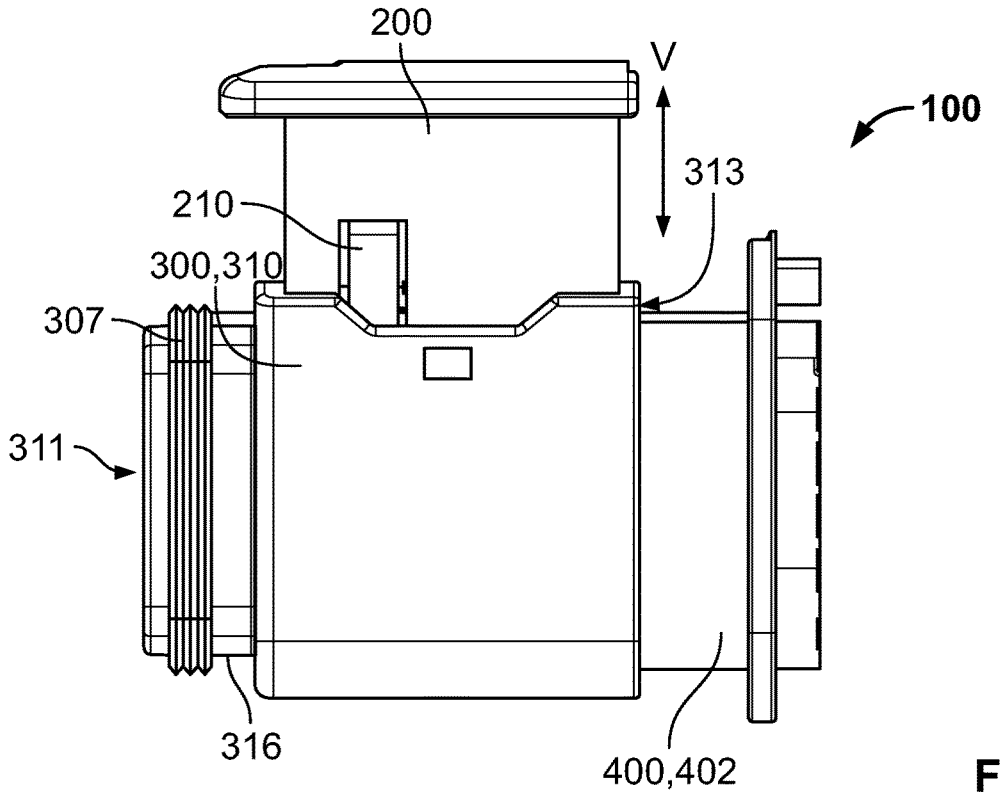
FIG. 1A is a side perspective view of a connector assembly including a receiving connector and a mating connector according to an embodiment of the present disclosure in a partially mated or partially connected state.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

An electrical connector assembly according to an embodiment of the present disclosure includes a first or receiving connector, and a second or mating connector selectively connectable to the receiving connector. In one embodiment, the receiving connector comprises a self-ejecting (or self-rejecting) and locking assembly adapted to both automatically disconnect the first and second connectors from a partially mated or partially connected state, as well as lock the connectors in a fully mated or connected state in response to a mating force placed thereon by a user. The ejecting and locking assembly is further adapted to partially disconnect the connectors from the mated state in response to a disconnection force placed thereon by a user, and to continue to automatically bias the connectors into an unmated state after the disconnection force is removed. In this way, connectors according to embodiments of the present disclosure are adapted to safely lock in the mated state, and aid in connector disconnection from the mated state. Moreover, the ejecting and locking arrangements described herein prevent the partial mating of the connectors by automatically ejecting or disconnecting the connectors from one another when only partially mated, such as in the event a user prematurely releases a mating force placed on the connectors prior to achieving the mated and/or locked state therebetween.

Figure 1B:
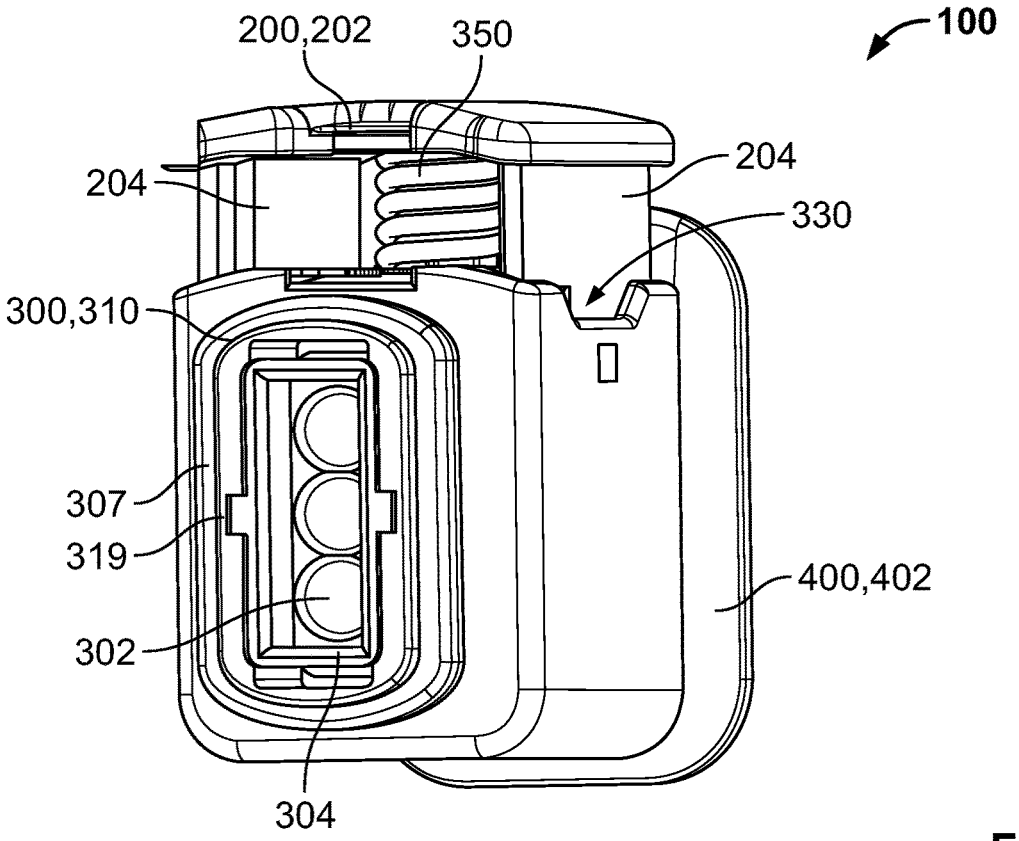
FIG. 1B is a perspective view of the connector assembly of FIG. 1A.
Figure 2:
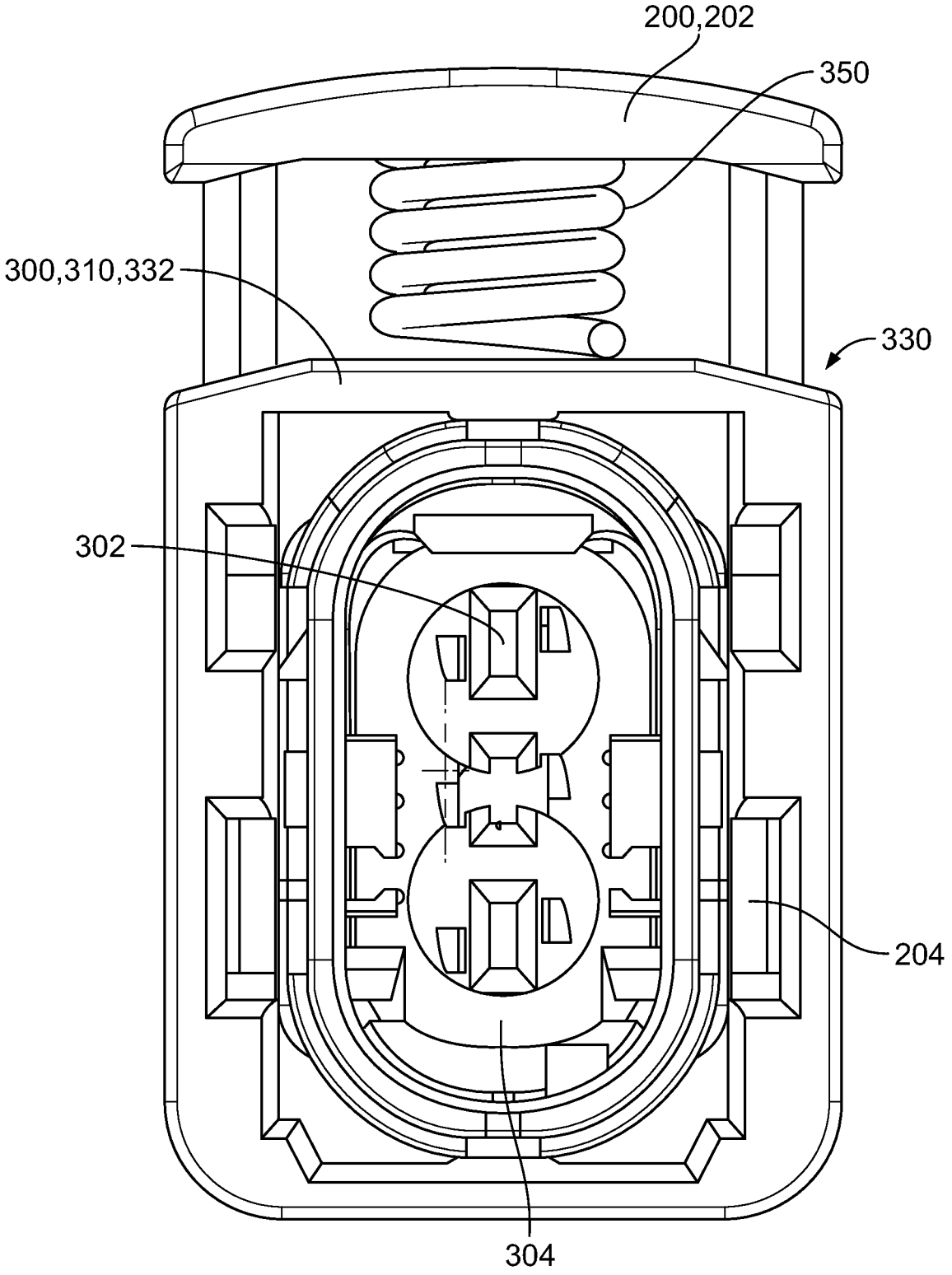
FIG. 2 is a front view of the receiving connector of FIGS. 1A and 1B.

Referring to FIGS. 1A, 1B and 2, a connector assembly 100 according to an embodiment of the present disclosure includes a first or receiving connector 300, and a second or mating connector 400 in a partially mated or partially connected state. The receiving connector 300 includes a body 310 having a rear or first open end 311 through which a plurality of conductors (e.g., a plurality of wires) are received for connecting to a corresponding plurality of terminals arranged within respective terminal holders 302 of the receiving connector. The first open end 311 of the body 310 comprises a protruding lip 316 extending therefrom and generally surrounding the open end 311, and may include opposing guide features (e.g., opposing slots) 319 for receiving a terminal body 304 supporting the terminals and terminal holders 302 within the body. A retaining surface 307 may be defined over the protruding lip 316, for engaging with, for example, a sealing boot. The terminals and terminal holders 302 extend through the body 310 and into a receiving space of a front or second open end 313 defined in the body 310. A mating end 402 of the mating connector 400 is adapted to be received within the second open end 313 for engaging a plurality of mating terminals thereof with the terminals and terminal holders 302 for establishing an electrical connection between.

An ejecting and locking assembly of the receiving connector 300 and/or the mating connector 400 includes a slide 200 moveably connected to the body 310 of the receiving connector 300. The slide 200 is generally U-shaped in profile, and includes a pair of legs 204 extending generally perpendicularly from opposite edges of a base 202. The slide 200 is moveable relative to the body 310 in each vertical direction V in the illustrated orientation. Each leg 204 engages with the body 310 for moveably connecting the slide thereto. In one embodiment, the body 310 comprises corresponding slots 330 formed therein and extending in the vertical direction from a top of the body toward a bottom of the body, with each slot configured to slidably receive a corresponding one of the legs 204 of the slide 200 in the illustrated manner. The base 202 is sized and shaped to be depressed by a user in the direction of the connector body 310 by, for example, their finger or thumb. An elastic element 350, such as a coil spring, is arranged between the top of the body 310 an underside of the base 202 of the slide 200, by way of example only. The elastic element 350 is adapted to bias the slide 200 into the illustrated extended or released position, in a direction generally away from the body 310. The slide 200 is retained within the base 310 in the extended position against the biasing force of the elastic element 350 via, for example, a pair of elastic catches 210, each formed or defined in a respective one of the legs 204. As shown in further detail in FIG. 2, each catch 210 includes an inwardly-extending protrusion 212 on a free end thereof configured to engage with a corresponding opposing latching feature formed within the slot 330 of the body 310, for example, an edge 332 of a top wall of the body 310. In this way, each catch 210 and accompanying slot 330 forms a mechanical stop, limiting the travel of the slide 200 relative to the body 310 in a vertically upward direction, thus preventing the elastic element 350 from ejecting the slide 200 from the body 310. As shown, the slide 200 and the elastic element 350 form self-returning button or actuator of the receiving connector 300 for controlling the self-ejecting and locking assembly according to embodiments of the present disclosure.

Figure 3:
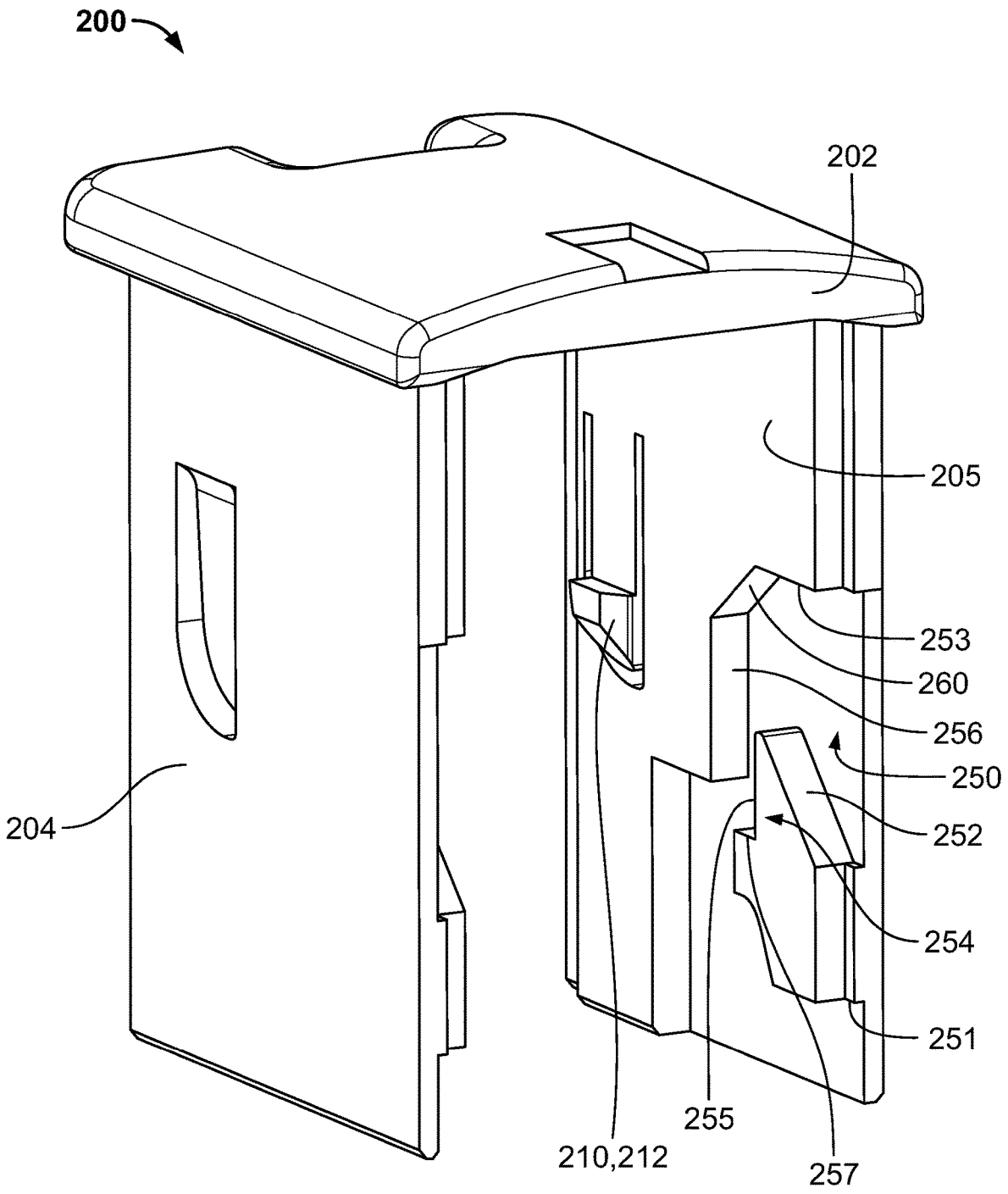
FIG. 3 is a perspective view of an actuator or slide of a receiving connector according to an embodiment of the present disclosure.

FIG. 3 provides a detailed perspective view of the slide 200. As shown, each catch 210 comprises a cantilevered arm supported by or formed integrally with a respective leg 204 of slide 200 on a first end thereof. A free end of each catch 210 defines the inwardly-extending protrusion 212 forming a catching surface generally facing the vertically upward direction. The catch 210 comprises an elastic arm, wherein the free end is deflectable laterally in an elastic manner. In this way, as the legs 204 of the slide 200 are initially inserted into the slots 330 of the body 310, the catches 210 are deflected generally outwardly. As the slide 200 is inserted further into the body 310, the catches 210 are permitted to elastically return inwardly as the protrusions 212 pass corresponding edges 332 of the slots 330, with the edges forming opposing latch surfaces. With the protrusions 212 engaged with the edges 332, the slide 200 is generally prevented from being ejected from the body 310 under the biasing force applied thereon by the elastic element 350.

Still referring to FIG. 3, in the exemplary embodiment, an interior surface 205 of each leg 204 defines one or more guide and/or cam surfaces forming part of the ejecting and locking assembly. More specifically, the opposing interior surfaces 205 of the legs 204 define a pair of guide slots 250 (with one shown in FIG. 3) each defining an open end configured to receive a corresponding second guide or cam surface (e.g., a protruding cam follower 410) formed on the mating connector 400 inserted into the receiving connector 300 in a mating direction. The guide slot 250 further comprises a first cam surface or ejecting cam 252 defining an inclined ramp extending from a bottom surface 251 of the guide slot 250 and generally upwardly toward a top surface 253 of the guide slot 250 in the mating direction. A locking opening or channel 254 is defined behind the first cam surface 252 in the mating direction, and is defined by a rear wall 256, a wall 255 of the first cam surface 252, and a bottom or stop wall 257, with the wall 255 and the rear wall 256 at least partially overlapping in the vertical direction. The guide slot 250 further comprises a second cam surface or disconnecting cam 260 defining a declining ramp in the insertion or mating direction (or an inclined ramp in a direction of ejection or unmating). The second cam surface 260 is defined on the top surface 253 of the guide slot 250 opposite the first cam surface 252 formed on the bottom surface or wall 251 of the guide slot 250. As illustrated, an end of the first cam surface 252 is vertically aligned with a start of the second cam surface 260 in the direction of insertion.

Figure 4A:
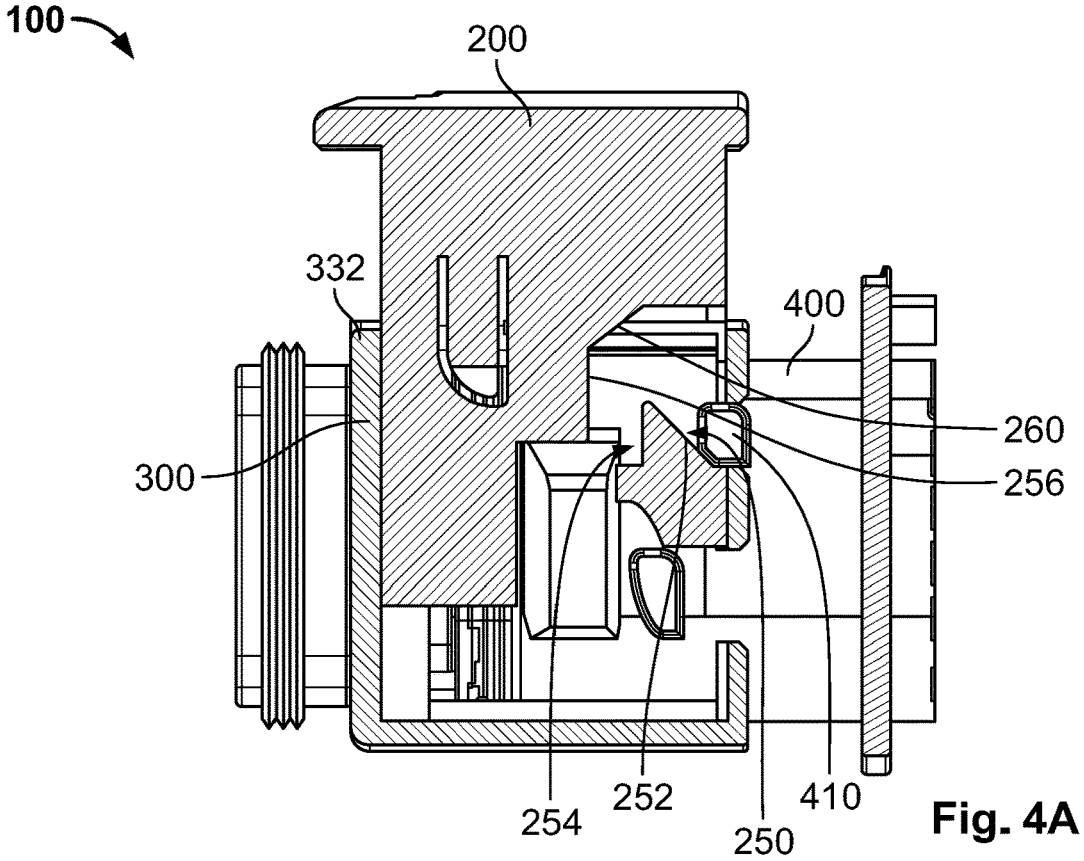
FIG. 4A is a side cross-sectional view of the connector assembly of FIGS. 1A, 1B and 2, with the mating connector in a first or initial mating position.

The operation of the ejecting and locking assembly or mechanism according to embodiments of the present disclosure is shown FIGS. 4A-5E. Referring to FIG. 4A, the mating connector 400 is shown in an initial mating position with respect to the receiving connector 300. A protruding guide element or cam follower 410 of the mating connector 400 is received within the guide slot 250 of each leg 204 of the slide 200. In the initial mating position, the cam follower 410 abuts a first end of the first cam surface 252. With the follower 410 engaging the first cam surface 252, the mating connector 400 is resisted from further insertion into the receiving connector 300 in the mating direction by the force applied on the slide 200 in the vertical direction via the elastic element 350 which resists the depression of the slide relative to the body of the receiving connector.

Figure 4B:
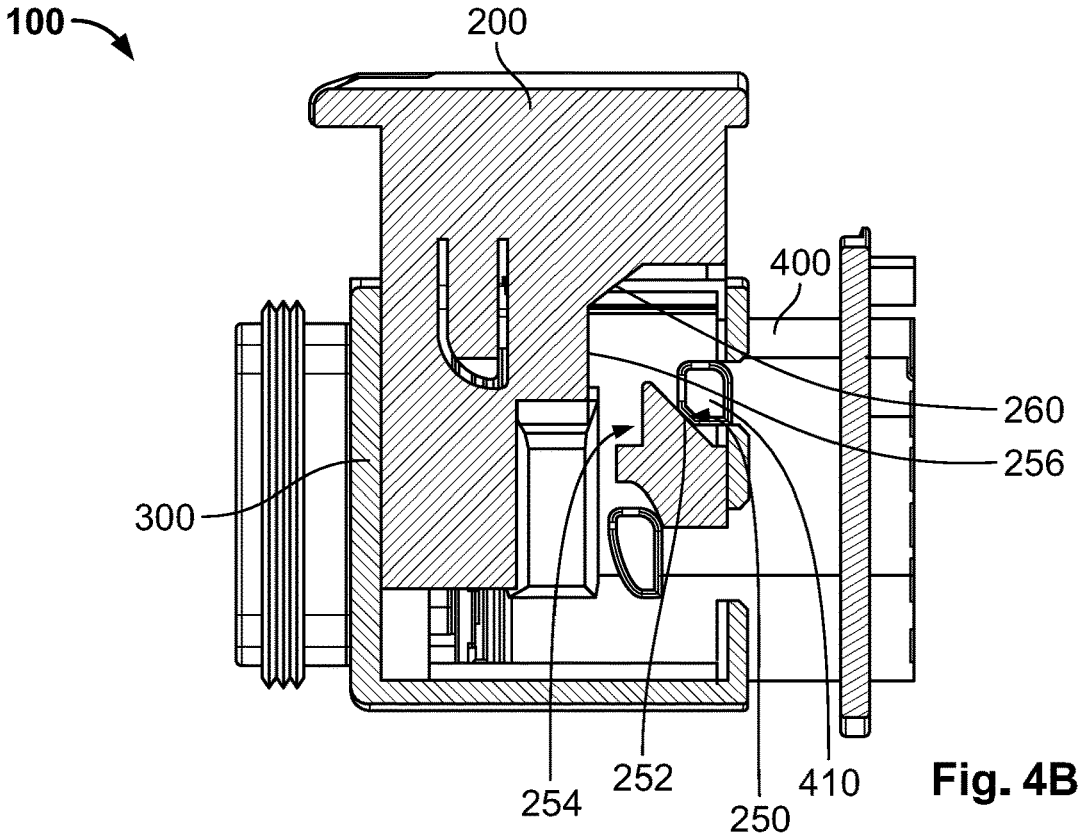
FIG. 4B is a side cross-sectional view of the connector assembly of FIG. 4A, with the mating connector in a partially installed position with the receiving connector during a mating operation.

Referring to FIG. 4B, continued axial or insertion force on the connector 400 (or the connector 300) in the mating or insertion direction advances the follower 410, wherein the slide 200 is biased downwardly, compressing the elastic element 350 as the follower 410 slides relative to and along the first cam surface 252. It should be understood that, with the follower 410 in the illustrated position associated with a partially-mated state of the connectors (prior to the follower 410 advancing past the first cam surface 252), if the axial insertion force on the mating connector 400 is released, the mating connector 400 will be self-ejected or biased in a direction opposite the mating direction. Specifically, the stored energy in the compressed elastic element 350 will urge the slide 200 in the upward direction, engaging the first cam surface 252 with the follower 410. As a result, the follower 410 is forcibly advanced down the rising first cam surface 252, and the mating connector 400 is ejected. In this way, partial connections of the mating connector 400 and the receiving connector 300 are prevented.

Figure 4C:
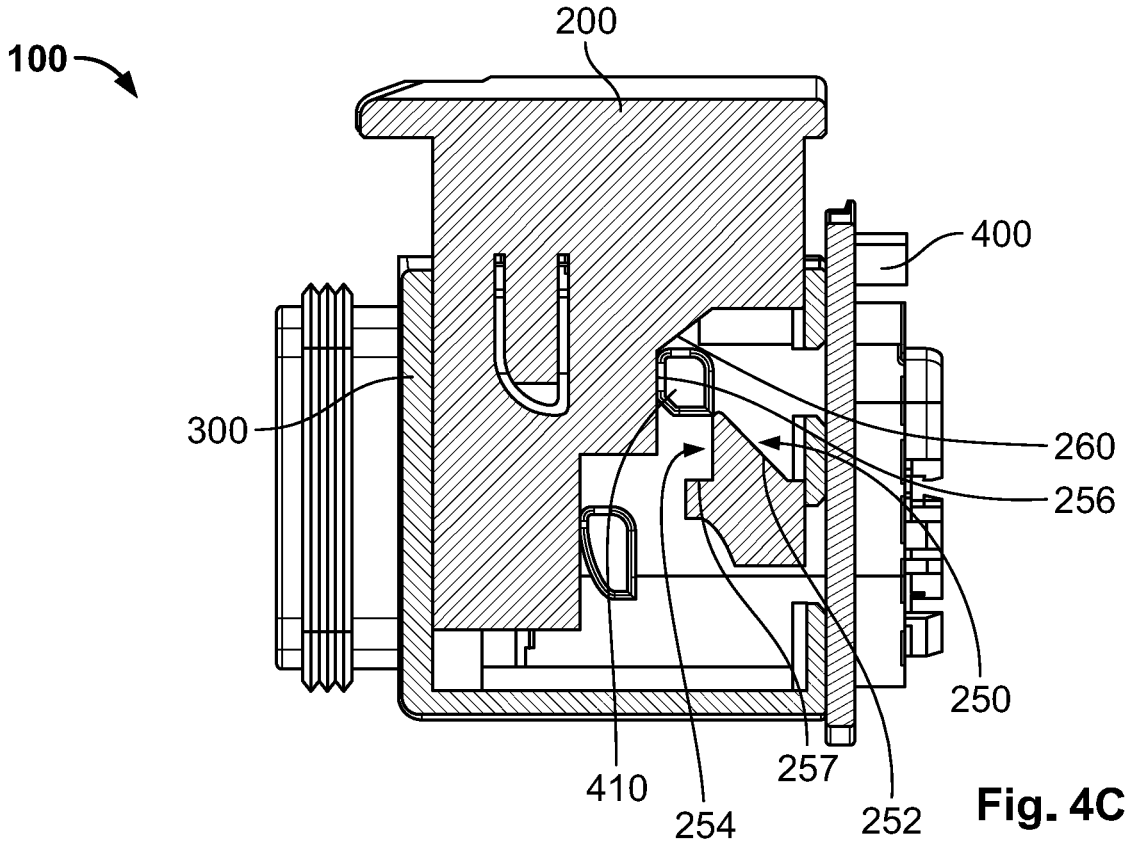
FIG. 4C is a side cross-sectional view of the connector assembly of FIG. 4A, with the mating connector in an installed or mated position with the receiving connector, and in an unlocked state during a mating operation.

As shown in FIG. 4C, from the position shown in FIG. 4B, continued insertion of the mating connector 400 in the mating direction advances the follower 410 past the first cam surface 252. Once past, the slide 200 is free to return upwardly under the force of the elastic element 350, with the locking opening 254 advancing vertically relative to follower 410, securing the follower within the locking opening as the follower approaches the bottom or stop wall 257. In this locked state or position illustrated in FIG. 4D, the mating connector 400 and the receiving connector 300 cannot be separated by the application of a tension force placed on either connector in the unmating direction.

Figure 4D:
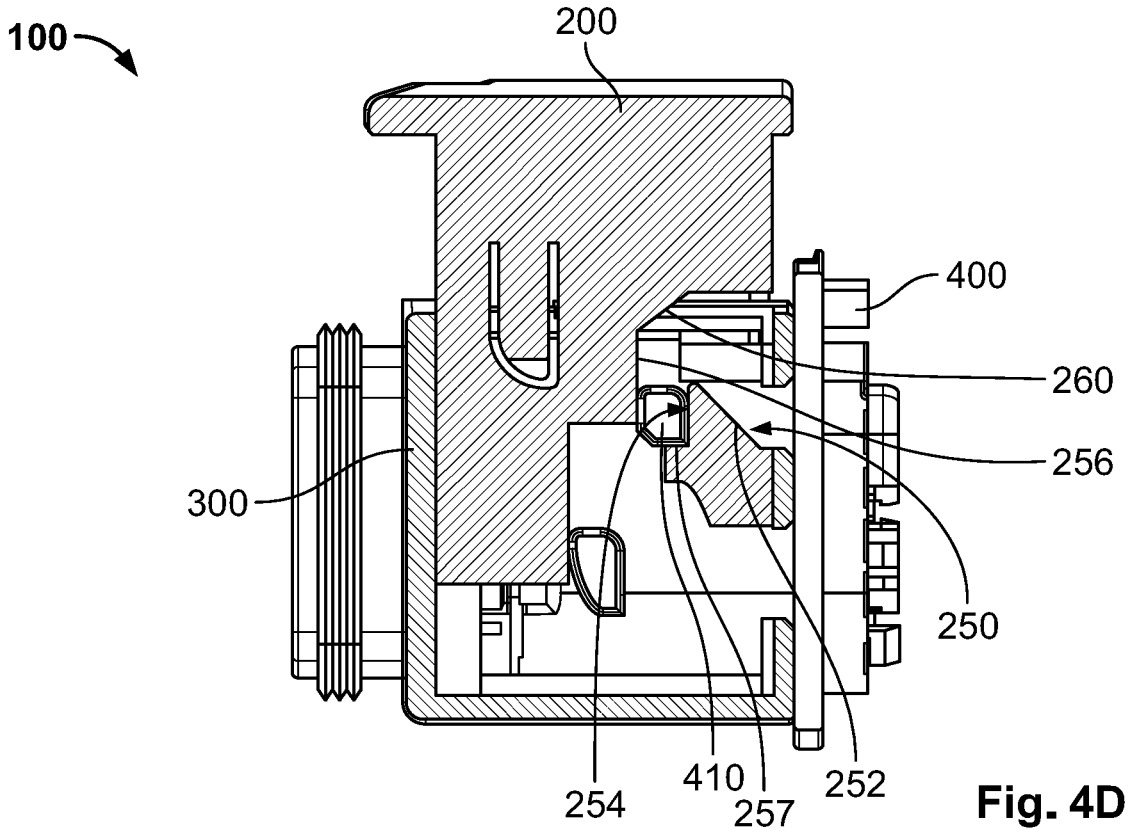
FIG. 4D is a side cross-sectional view of the connector assembly of FIG. 4A, with the mating connector in the installed position with the receiving connector, and in a locked state.
Figure 5A:
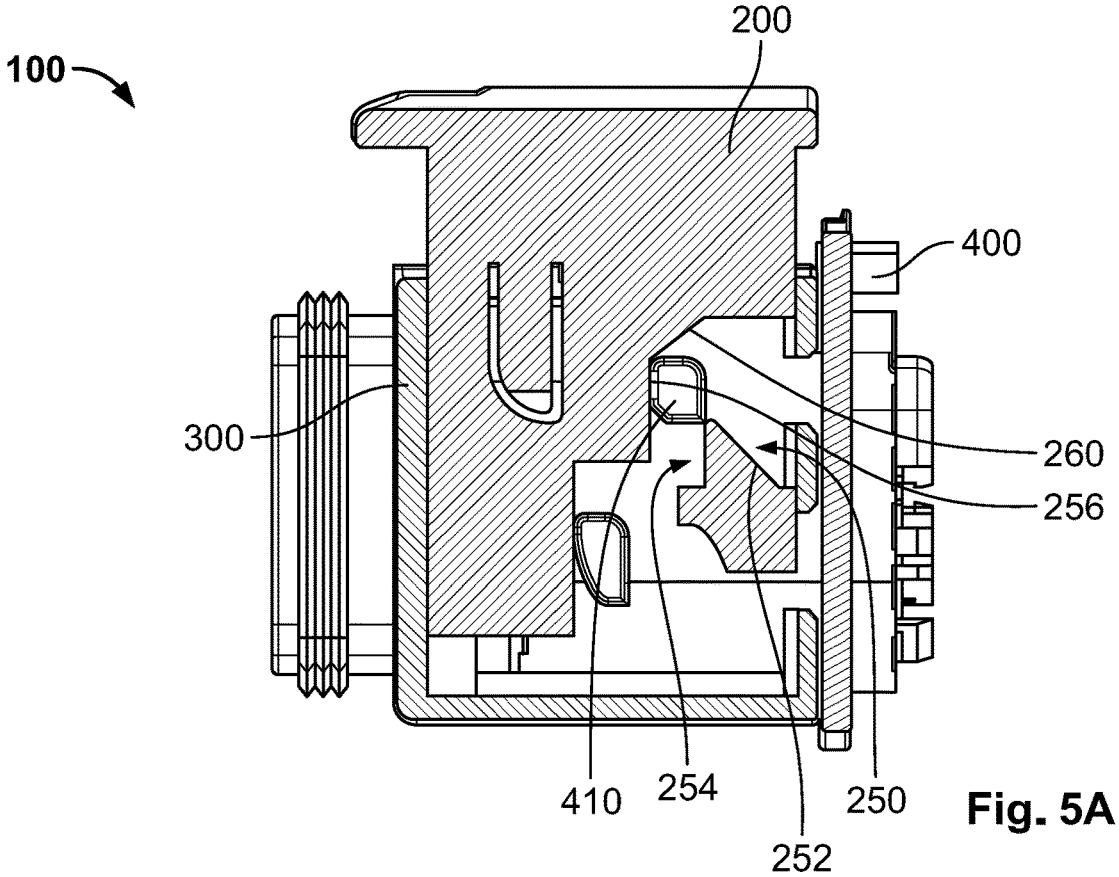
FIG. 5A is a side cross-sectional view of the connector assembly of FIGS. 1 and 2, with the mating connector in an installed position with the receiving connector, and in an unlocked state during an unmating operation, with the slide in a depressed state.
Figure 5B:
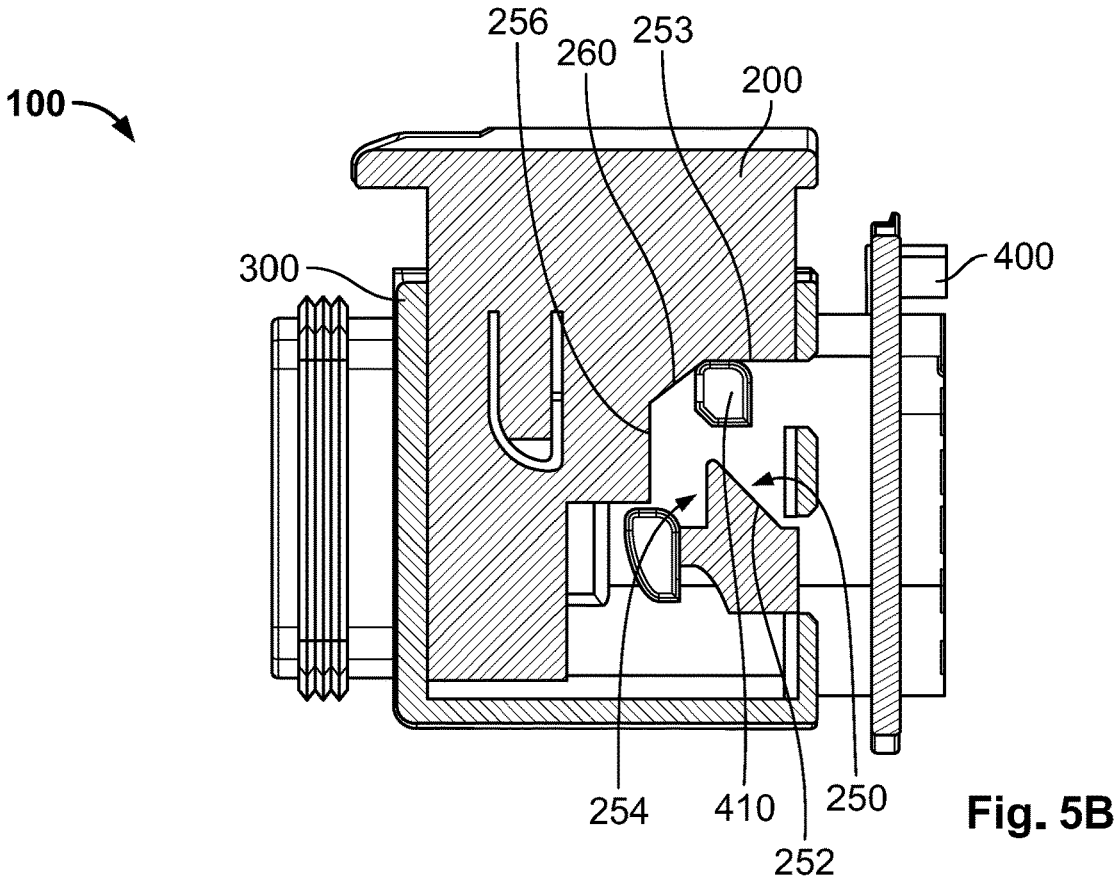
FIG. 5B is a side cross-sectional view of the connector assembly of FIG. 5A, with the mating connector in a partially unmated position with the receiving connector, with the slide in a depressed state.

In order to disconnected the mating connector 400 from the receiving connector 300, a user places a depressive force on the slide 200, compressing the elastic element 350 and advancing the locking opening or passage 254 relative to the follower 410 from the position shown in FIG. 4D to the position shown in FIG. 5A. Continued pressure on or depression of the slide 200 is operative to engage the second cam surface 260 with the follower 410, wherein the follower (and the mating connector 400) is biased in the unmating or ejection direction as the second cam surface bears thereon. With reference to FIG. 5B, the result of this action is the partial disconnection or separation of the mating connector 400 from the receiving connector 300. It should be understood that as the cam follower 410 has cleared the second cam surface 260 and is abutting the top surface 253 of the guide slot 250, further downward pressure on the slide 200 does not further disengage or unmate the connectors. This bottoming out of the slide 200 may indicate to a user that the connector has been partially disengaged. The above functionality may be useful for facilitating the overcoming of high initial separation forces required to at least partially disconnected the terminals of each connector.

Figure 5C:
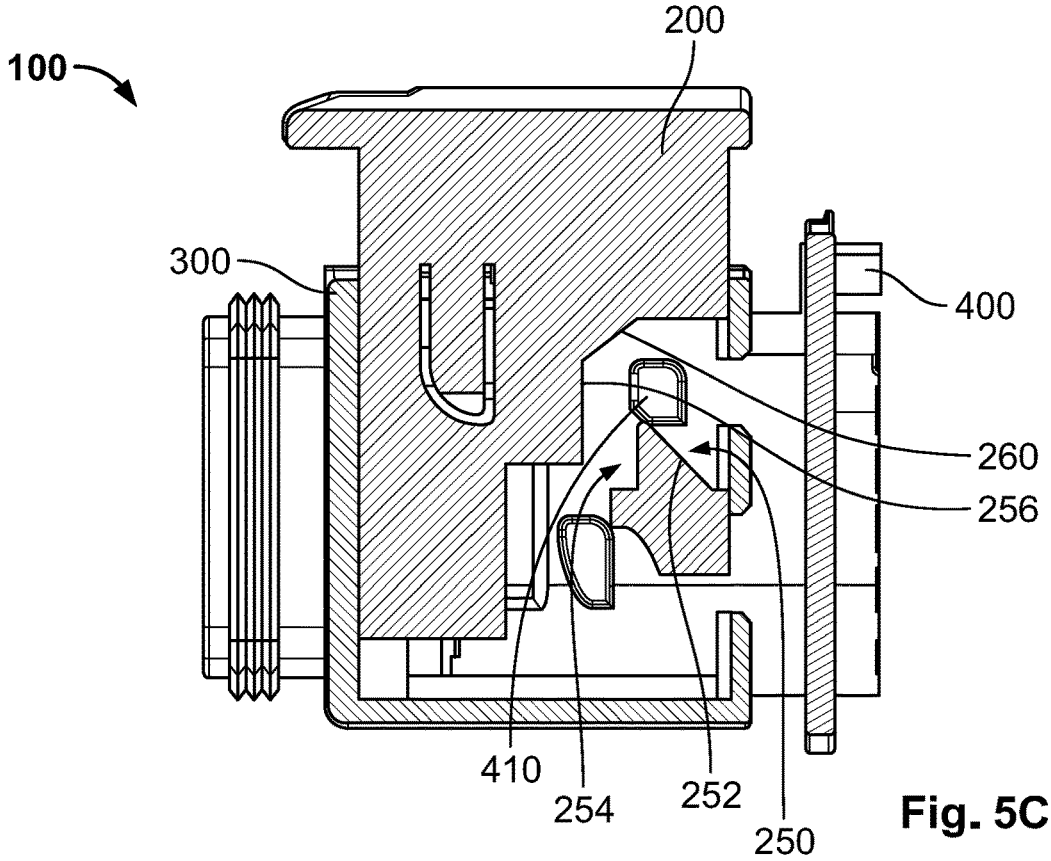
FIG. 5C is a side cross-sectional view of the connector assembly of FIG. 5A, with the mating connector in a partially unmated position with the receiving connector, with the slide in a released state.
Figure 5D:
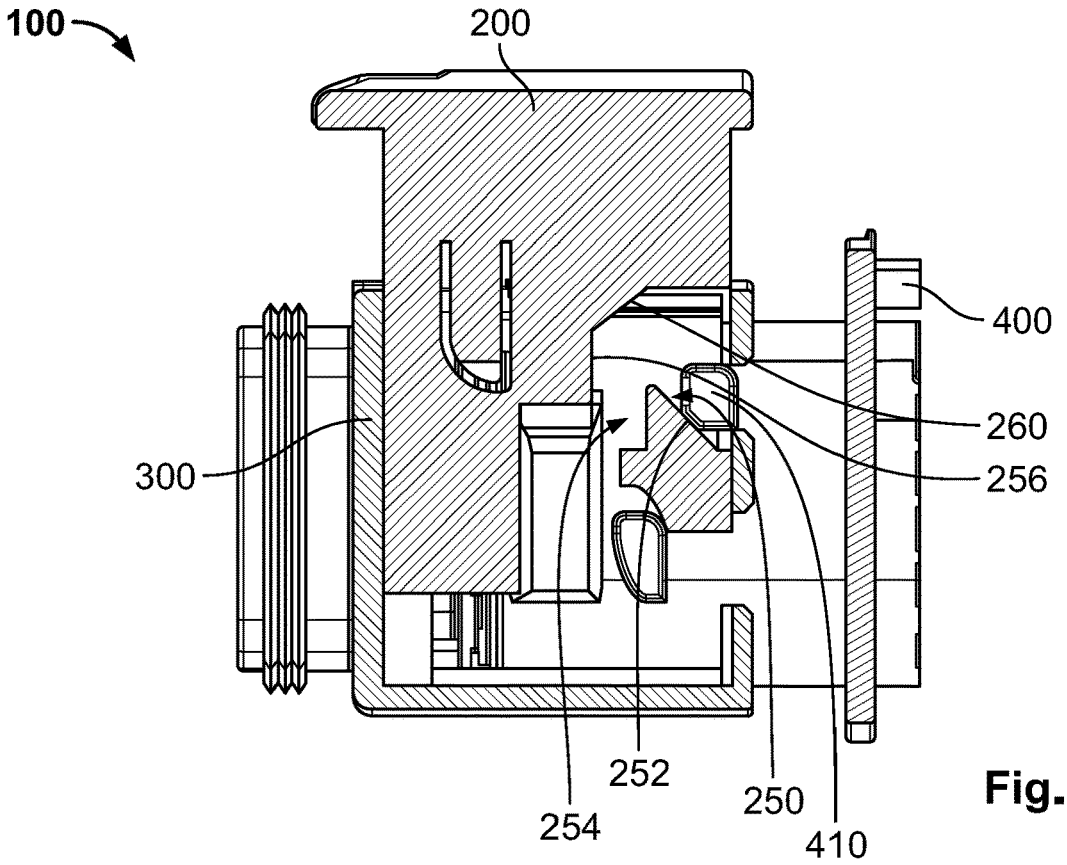
FIG. 5D is a side cross-sectional view of the connector assembly of FIG. 5A, with the mating connector in the partially unmated position with the receiving connector as it is automatically unmated, with the slide in the released state.
Figure 5E:
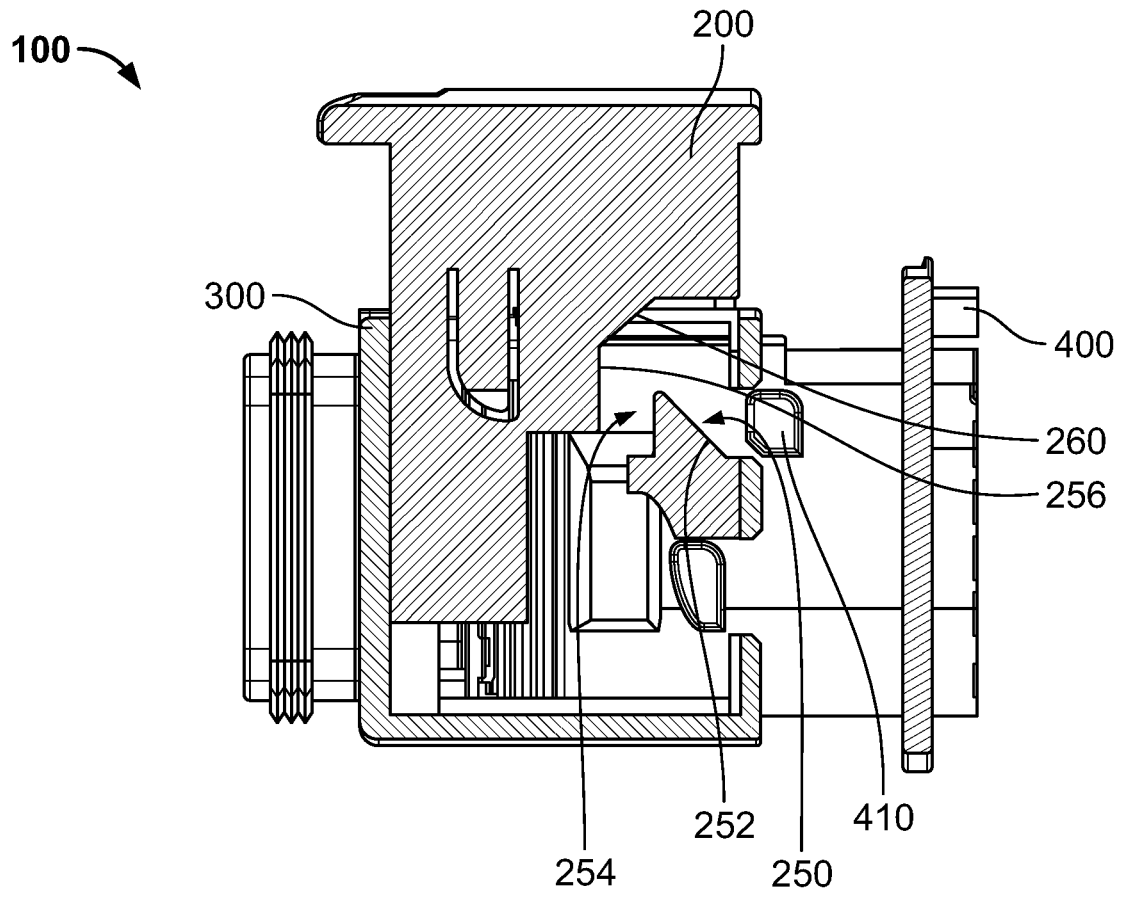
FIG. 5E is a side cross-sectional view of the connector assembly of FIG. 5A, with the mating connector in an unmated position with the receiving connector after being automatically unmated, with the slide in a released state.

Referring now to FIG. 5C, as a result of the vertical alignment of the end of the second cam surface 260 and the first cam surface 252, once the connectors are partially disengaged with the slide 200 fully depressed, a user may release the slide for automatically ejecting the mating connector 400 from the receiving connector 300. Specifically, as set forth above, releasing the downward pressure on the slide 200 from the position illustrated in FIG. 5B permits the slide to raise vertically under the bias of the elastic member 350, engaging the follower 410 with the second end of the ejecting or first cam surface 252. Once engaged, the elastic return force will continue to drive the first cam surface 252 into the follower 410, biasing the follower in the unmating direction, ejecting the mating connector 400 from the receiving connector 300, without further pressure applied to the connector(s) by a user, as shown in FIGS. 5D and 5E.

While embodiments are described herein as incorporating the linear cam surfaces associated with the moveable slide, and corresponding cam followers on the mating connector, it should be understood these elements may also be embodied in the opposite arrangement, with the guides or cam followers formed on or with the moveable slide, and the ramped cam surfaces defined on the mating connector, without departing from the scope of the present disclosure.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. An electrical connector assembly, comprising:

a first connector including:

a body;

a slide movably connected to the body; and an elastic element adapted to bias the slide relative to the body in a first direction;

a second connector adapted to be mated to the first connector in a mating direction; and an ejecting assembly including a guide slot defining a plurality of cam surfaces on one of the slide or the second connector, the guide slot is defined by a top wall and a bottom wall, the top wall has a first cam surface, the bottom wall has a second cam surface at an opening of the guide slot that is adapted to bias the second connector in a direction opposite the mating direction in response to movement of the slide in the first direction via the elastic return force imparted on the slide by the elastic element, the top wall has a surface at the opening that extends parallel to the mating direction and is opposite the second cam surface in a vertical direction.

2. The electrical connector assembly of claim 1, wherein the first cam surface is adapted to bias the second connector from a mated state with the first connector in the direction opposite the mating direction in response to a movement of the slide in a second direction opposite the first direction.

3. The electrical connector assembly of claim 2, wherein the ejecting assembly comprises:

a cam follower defined on the other one of the slide or the second connector and receivable within the guide slot for engaging with the plurality of cam surfaces.

4. The electrical connector assembly of claim 2, wherein the first cam surface defines a declining ramp surface in an insertion direction of the mating connector.

5. The electrical connector assembly of claim 4, wherein the second cam surface defines an inclining ramp surface in the insertion direction of the mating connector.

6. The electrical connector assembly of claim 3, wherein the cam follower is configured to be received by and travel along the guide slot between the opening thereof and an end corresponding to a mated state of the connectors.

7. The electrical connector assembly of claim 6, wherein the guide slot defines:

the opening receiving the follower in the mating direction of the connectors;

a locking opening receiving the follower in the mated state of the connectors, the locking opening defining a mechanical stopping surface opposing motion of the follower in the direction opposite the mating direction;

the first cam surface arranged above the locking opening and configured to bias the follower in the direction opposite the mating direction in response to a force placed on the slide in a direction opposite the elastic return force imparted by the elastic member; and the second cam surface arranged on the bottom wall of the opening and inclining in the insertion direction of the second connector.

8. The electrical connector assembly of claim 7, wherein the locking opening is arranged behind the second cam surface in the mating direction.

9. The electrical connector assembly of claim 8, wherein, in the mating direction, an end of the second cam surface is aligned with a beginning of the first cam surface in the vertical direction.

10. The electrical connector assembly of claim 9, wherein the second connector is moveable relative to the first connector between an initial position and a mated position, wherein the second cam surface is engaged with the follower between the initial position and the mated position of the connectors such that the ejecting assembly automatically biases the second connector toward the initial position until the second connector is in a mated position with the first connector.

11. An electrical connector, comprising:

a body configured to receive a mating electrical connector in a mating direction;

a slide movably connected to the body and defining a guide slot with a cam surface, the guide slot is defined by a top wall and a bottom wall; and an elastic element adapted to bias the slide relative to the body in a first direction, wherein the cam surface has:

a first ramp on the top wall biasing the mating connector from a mated position with the body into a partially mated position in response to a force placed on the slide in a direction opposite the first direction and against an elastic return force imparted on the slide by the elastic element; and a second ramp on the bottom wall biasing the mating connector from the partially mated position to an ejected position under a force applied to the slide by the elastic element, the second ramp is adjacent to an opening of the guide slot, the top wall has a surface at the opening that extends parallel to the mating direction and is opposite the second ramp in a vertical direction.

12. The electrical connector of claim 11, wherein the second ramp extends between a position corresponding to an initial installation position of the mating connector and a position corresponding to the mated position of the mating connector.

13. The electrical connector of claim 12, wherein the first second ramp is biased into contact with a portion of the mating connector in response to an elastic return force applied to the slide by the elastic element.

14. The electrical connector of claim 12, wherein the first ramp has a direction of inclination opposite to that of an inclination of the second ramp, and wherein in the mating direction, the first ramp extends from a position corresponding to an end of the first second ramp of the cam surface.

15. The electrical connector of claim 14, wherein the first ramp is adapted to be biased into contact with a portion of the mating connector in response to a force applied to the slide in a second direction opposite the first direction.

16. The electrical connector of claim 11, wherein:

the mated position corresponds to a fully mated position of corresponding conducive electrical terminals of the connector and the mating connector;

the partially mated position corresponds to a partially mated position of the conducive electrical terminals of the connector and the mating connector; and the ejected position corresponds to an unmated position of the conducive electrical terminals of the connector and the mating connector.

* * * * *